US008710411B1

(12) United States Patent
LaPat

(10) Patent No.: US 8,710,411 B1
(45) Date of Patent: Apr. 29, 2014

(54) METHOD AND SYSTEM FOR DETERMINING AN OPTIMAL MISSILE INTERCEPT APPROACH DIRECTION FOR CORRECT REMOTE SENSOR-TO-SEEKER HANDOVER

(75) Inventor: Ronald H. LaPat, Westford, MA (US)

(73) Assignee: Lockheed Martin Corporation, Bethesda, MD (US)

( * ) Notice: Subject to any disclaimer, the term of this patent is extended or adjusted under 35 U.S.C. 154(b) by 801 days.

(21) Appl. No.: 12/893,605

(22) Filed: Sep. 29, 2010

Related U.S. Application Data

(60) Provisional application No. 61/246,784, filed on Sep. 29, 2009.

(51) Int. Cl.

| | |
|---|---|
| ***F41G 7/20*** | (2006.01) |
| ***F41G 7/22*** | (2006.01) |
| ***F41G 7/30*** | (2006.01) |
| ***F42B 15/01*** | (2006.01) |
| *F41G 7/00* | (2006.01) |
| *F42B 15/00* | (2006.01) |

(52) U.S. Cl.
USPC ..... 244/3.15; 244/3.1; 244/3.11; 244/3.16; 244/3.19

(58) Field of Classification Search
USPC ..... 244/3.1, 3.11–3.3; 89/1.11; 382/100, 382/103; 703/2, 6, 13, 22; 342/52–59, 61, 342/62, 175, 195
See application file for complete search history.

(56) References Cited

U.S. PATENT DOCUMENTS

| | | | | |
|---|---|---|---|---|
| 4,198,015 | A * | 4/1980 | Yates et al. | 244/3.15 |
| 5,435,503 | A * | 7/1995 | Johnson et al. | 244/3.15 |
| 5,637,826 | A * | 6/1997 | Bessacini et al. | 244/3.11 |
| 5,947,413 | A * | 9/1999 | Mahalanobis | 244/3.17 |
| 6,042,050 | A * | 3/2000 | Sims et al. | 244/3.17 |
| 6,150,974 | A | 11/2000 | Tasaka et al. | |
| 6,768,927 | B2 * | 7/2004 | Krogmann | 244/3.19 |
| 6,806,823 | B1 | 10/2004 | Smith et al. | |
| 7,046,823 | B2 * | 5/2006 | Albus et al. | 382/103 |
| 7,183,966 | B1 | 2/2007 | Schramek et al. | |
| 7,233,859 | B2 * | 6/2007 | Lundberg | 244/3.1 |
| 7,444,002 | B2 * | 10/2008 | Teku et al. | 382/103 |
| 7,552,669 | B1 * | 6/2009 | Denis et al. | 89/1.11 |
| 7,968,831 | B2 * | 6/2011 | Meyer et al. | 244/3.15 |

* cited by examiner

*Primary Examiner* — Bernarr Gregory
(74) *Attorney, Agent, or Firm* — Howard IP Law Group PC

(57) ABSTRACT

A method and system for determining an optimal missile intercept approach direction to maximize the probability of association between a remote sensor designated object and a corresponding missile seeker-observed object. The method and system calculates a distance metric between a remote sensor designated object and the corresponding missile seeker-observed object, and calculates the probability that the remote sensor designated object and the corresponding missile seeker-observed object have a smaller distance metric between them than between the remote sensor designated object and any other missile seeker-observed object.

17 Claims, 6 Drawing Sheets

METHOD AND SYSTEM FOR DETERMINING AN OPTIMAL MISSILE INTERCEPT APPROACH DIRECTION FOR CORRECT REMOTE SENSOR-TO-SEEKER HANDOVER

RELATED APPLICATION

This application claims the benefit of U.S. Provisional Application No. 61/246,784, filed Sep. 29, 2009, the entire disclosure of which is incorporated herein by reference.

FIELD

The disclosure relates to target tracking methods and systems. More particularly, the disclosure relates to a method and system that maximizes the probability of correct remote sensor-to-seeker track association (handover).

BACKGROUND

High-velocity guided missiles are used for intercepting very fast moving objects on land, in the air or in space, such as ballistic rockets, or highly maneuverable objects. Such missiles use a seeker to detect and guide the missile to the intended object.

In many missile defense applications, target discrimination and designation (missile or interceptor targeting) is initially performed by a sensor located remote from the missile (e.g., radar) which must somehow relay one or more tracks to the missile's seeker in order to complete interceptor targeting. The process of relaying the designated targeted object(s) from the remote sensor to the seeker is referred to herein as "handover" or "object association."

The handover process is complicated by measurement noises, differences in perspective (reference frame), and often differences in spectrum between the remote sensor and the seeker, especially when the target environment is dense with multiple objects (tracks).

Not all intercept geometries, however, are equal. Handover performance (i.e. the probability of correct object association) can be improved if the missile can be made to approach the dense complex of objects from an advantageous approach direction, one that exploits the characteristics of measurement noises, known geometries, and the density of the target environment.

Accordingly, a method and system are needed for determining an optimal missile intercept approach direction for maximizing probability of correct handover.

SUMMARY

A method and system are disclosed herein for determining an optimal missile intercept approach direction to maximize the probability of association between a remote sensor designated object and a corresponding missile seeker-observed object. One embodiment of the method and system comprises calculating a distance metric, as a function of bistatic angle, between the remote sensor designated object and the corresponding missile seeker-observed object of each set, and calculating, for each set, the probability that the remote sensor designated object and the corresponding missile seeker-observed object of that set have a smaller distance metric between them than any other set of remote sensor designated and missile seeker-observed objects.

Another embodiment of the method and system comprises scanning a plurality of bistatic angles between the remote sensor, the designated object, and the missile seeker and for each bistatic angle, transforming true kinematic states of the objects to a seeker reference frame, and repeatedly adding randomly selected remote sensor and seeker measurement noise, in Monte Carlo trials, to the true kinematic states of the remote sensor designated object and the corresponding missile seeker-observed object. For each instance of adding random measurement noise, a distance metric is calculated between the remote sensor designated object and the corresponding missile seeker-observed object, and for all instances of adding selected measurement noise, the probability is calculated that the remote sensor designated object and the corresponding missile seeker-observed object have a smaller distance metric between them than between the remote sensor designated object and any other missile seeker-observed object. The optimal missile intercept approach is deemed the bistatic angle with the highest probability that the remote sensor designated object and the corresponding missile seeker-observed object have a smaller distance metric between them than between the remote sensor designated object and any other missile seeker-observed object.

DETAILED DESCRIPTION

Figure 1A:
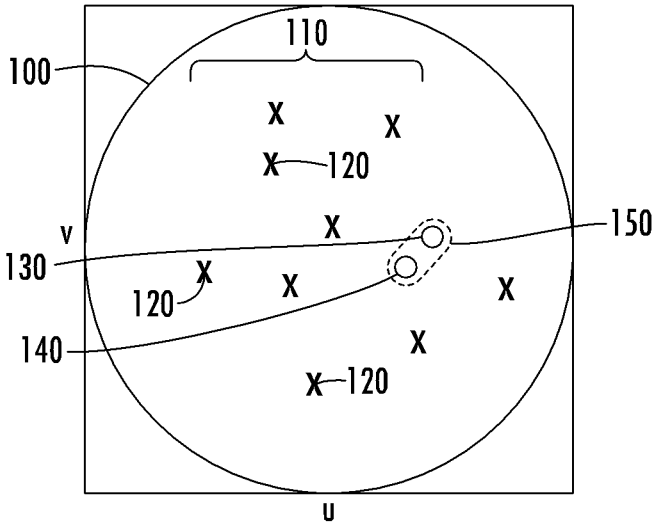
FIG. 1A is a diagram illustrating correct remote sensor-to-seeker handover or object association.
Figure 1B:
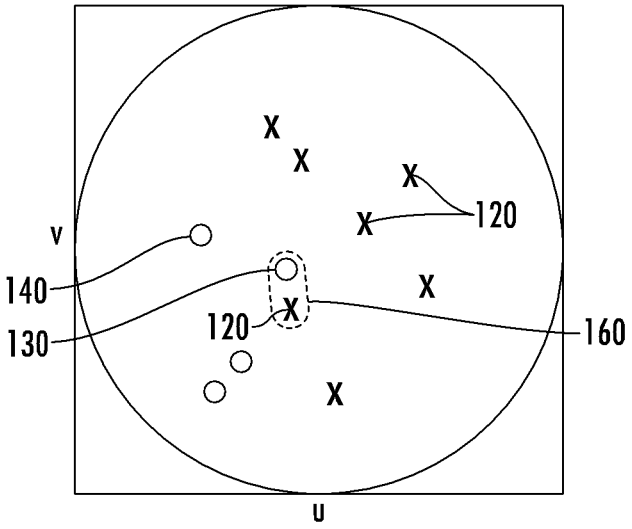
FIG. 1B is a diagram illustrating incorrect remote sensor-to-seeker handover or object association.

FIGS. 1A and 1B respectively illustrate correct and incorrect remote sensor-to-seeker handover or object association, where axes, U and V, respectively represent Sine Azimuth and Sine Elevation relative to a sensor face. Reference numeral 100 denotes a target environment. The target environment 100 contains a plurality of moving objects 110 including a designated object 130 observed by a remotely located sensor (e.g., radar) projected into the field of view (FOV) of a seeker of a missile, the corresponding (same) object 140 observed by the seeker of the missile, and non-corresponding objects 120 also observed by the seeker of the missile.

In FIG. 1A, the correct remote sensor-to-seeker handover or object association is represented by a broken line 150 surrounding the designated remote sensor- and seeker-observed objects 130 and 140. In FIG. 1B, the incorrect remote sensor-to-seeker handover or object association is represented by a broken line 160 surrounding the designated remote sensor-observed object 130 and one of the non-corresponding seeker-observed objects 120.

In accordance with the method of the present disclosure, an optimal in-flight missile intercept approach direction (and by inference, the preferred missile launch point) is determined that maximizes the probability of correctly associating the missile's seeker-observed objects with a designated remote sensor-observed object (the target environment can contain one or more remote sensor designated objects). The probability of correct object association can be the probability that the respective Mahalanobis Distance (MD), between the object (track) designated by the remote sensor, and the corresponding seeker-observed object (track) is smaller (or smaller on average if there are more than one designated object) than the MD to any non-corresponding seeker-observed track. The method is not limited to using the MD metric, as other suitable distance metrics can be used without loss of generality.

The MD is a covariance weighted distance metric between object tracks, i.e., $MD=[x_1-x_2]^T[P_1^2+P_2^2]^{-1}[x_1-x_2]$, where x is the object track state, P is the covariance of the respective object track states, and superscript T is transpose.

The covariance information may be viewed as having the shape of an ellipsoid whose major axes are defined by the range and the two cross ranges directions of the sensor face. The covariance ellipsoid represents the region or volume of space having some probability of containing a specified object. The bistatic angle determines the rotation of the covariance (error) ellipsoid from the remote sensor, which is projected onto the seeker FOV.

Mathematically, the method of the present disclosure can be expressed as follows:

$$\theta_{opt}=\theta:\max_{\theta} Pr\left\{\begin{array}{c}[\hat{x}_{Rdr}^{Skr}(0)-\hat{x}_{Skr}^{Skr}(0)]^T[P_{Rdr}^{Skr}(0)+\\ P_{Skr}^{Skr}(0)]^{-1}[\hat{x}_{Rdr}^{Skr}(0)-\hat{x}_{Skr}^{Skr}(0)]\\ <\\ [\hat{x}_{Rdr}^{Skr}(0)-\hat{x}_{Skr}^{Skr}(k)]^T[P_{Rdr}^{Skr}(0)+\\ P_{Skr}^{Skr}(k)]^{-1}[\hat{x}_{Rdr}^{Skr}(0)-\hat{x}_{Skr}^{Skr}(k)]\end{array}\right\}\forall k\neq 0$$

Where, $\hat{x}_{Rdr}^{Rdr}(0)=C_{Nav}^{Rdr}\cdot x^{Nav}(0)+N(0,P_{Rdr}^{Rdr}(0))$ (Reference Frame; Object; Observer)

$$\hat{x}_{Rdr}^{Skr}(k)=C_{Nav}^{Skr}\cdot x^{Nav}(k)+N(0,P_{Skr}^{Skr}(k))\ \forall k$$

$$\hat{x}_{Rdr}^{Skr}(0)=C_{Rdr}^{Skr}(\theta)\cdot\hat{x}_{Rdr}^{Rdr}(0),$$

$$P_{Rdr}^{Skr}(k)=C_{Rdr}^{Skr}(\theta)\cdot P_{Rdr}^{Rdr}(k)\cdot[C_{Rdr}^{Skr}(\theta)]^T\forall k \quad \text{and}$$

$$C_{Rdr}^{Skr}(\theta)=C_{Nav}^{Skr}\cdot[C_{Nav}^{Rdr}]^T;$$

(Final Reference Frame; Initial Reference Frame; Bistatic Angle)

$$\theta=\cos^{-1}\left\{\frac{[x^{Nav}(0)-x^{Nav}(Rdr)]^T}{\|x^{Nav}(0)-x^{Nav}(Rdr)\|}\cdot\frac{[x^{Nav}(0)-x^{Nav}(Skr)]}{\|x^{Nav}(0)-x^{Nav}(Skr)\|}\right\}$$

and where $\hat{x}$ represents the estimate of true object track state, C represents a transformation from subscripted reference frame to the superscripted reference frame, k indexes the object number, k=0 represents the designated object, N represents a normal distribution, P represents covariance, Nav represents a common navigation reference frame, Skr represents a seeker reference frame, and Rdr represents a remote sensor reference frame.

Using the examples shown in FIGS. 1A and 1B, correct handover or object association is achieved when the MD between the designated remote sensor-observed object 130 and the corresponding seeker-observed object 140 is smaller than the MD between the designated remote sensor-observed object 130 and any of the non-corresponding seeker-observed objects 120.

Figure 2:
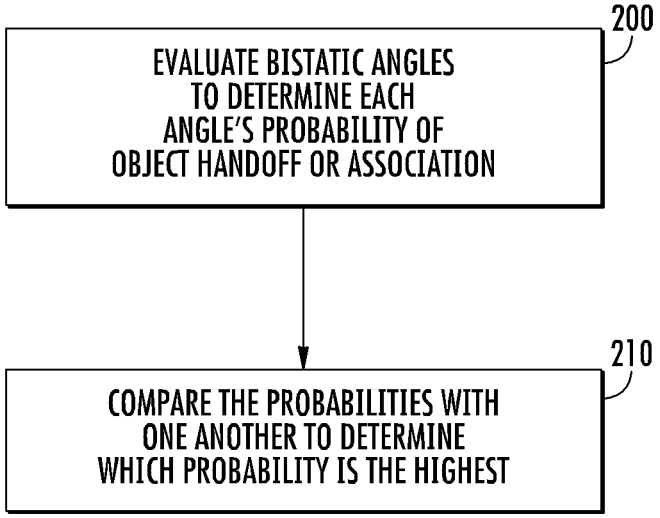
FIG. 2 is a flow chart of the method for determining the optimal in-flight missile intercept approach direction.

In the method for determining the optimal in-flight missile intercept approach direction, the probability of object association is determined by calculating the probability that a designated object observed by the remote sensor and the corresponding object observed by the seeker have a smaller Mahalanobis distance (MD) between them than between the remote sensor designated object and any other seeker-observed object. FIG. 2 is a flow chart describing one embodiment of the method for determining the optimal in-flight missile intercept approach direction using bistatic angles. In block 200 of the method, a plurality of bistatic angles, i.e., angle formed between the remote sensor, the designated object, and the seeker, are evaluated to determine each angle's probability of correct object handover or association between the remote sensor and the seeker-observed objects. In block 210, the probabilities of object handover or association are compared with one another to determine which probability is the highest. The bistatic angle yielding the highest probability of correct object handover or association yields the optimal in-flight missile intercept approach direction.

It should be understood that in other embodiments of the method, the optimal in-flight missile intercept approach direction may be determined analytically or numerically rather than by explicitly searching over bistatic angles, as indicated in FIG. 2.

Figure 3:
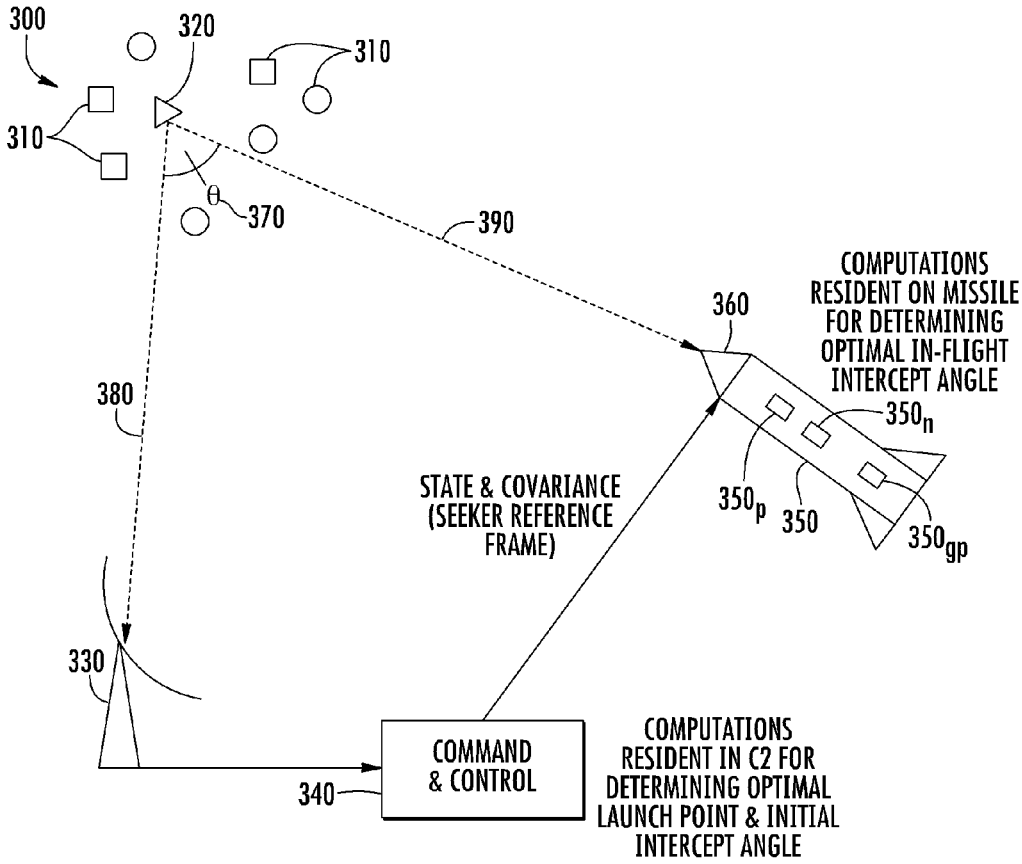
FIG. 3 illustrates an embodiment of a system for performing the method of determining the optimal in-flight missile intercept approach direction.

FIG. 3 illustrates an embodiment of a system for performing the method of determining the optimal in-flight missile intercept approach direction. Reference number 300 denotes a target environment containing a plurality of moving objects 310, one of which is designated object 320. A missile 350 having a bistatic RF seeker 360 (and optionally an IR seeker) is shown in-flight toward the plurality of moving objects 310. The bistatic seeker 360 observes object 320 via return signal 390. One or more remote sensors 330 (remote sensor 330) located remotely from the bistatic seeker 360 (seeker 360), observes and/or tracks designated object 320 via return signal 380. The remote sensor 330, which can be radar or any other suitable remote sensor, communicates with a command and control system 340. The remote sensor 330, the designated remote sensor/seeker-observed object 320, and the seeker 360 of the missile 350 subtend the optimal, in-flight missile intercept approach direction 370 (bistatic angle 370). The command and control system 340 determines the optimal missile launch point and the initial bistatic/in-flight missile intercept approach direction subtended among the remote sensor 330, the targeted or designated object 320, and the seeker 360 of the missile 350. The command and control system 360 transmits estimated track state data (i.e. position, velocity and acceleration data) about the designated object 320 and estimated track state errors about the remote sensor, command and control system 340, and seeker 360 (covariance data) to the seeker 360 of the missile 350. The track state and covariance data provided to the missile 350 by the command and control system 340 are transformed to the seeker's reference frame. In one embodiment, a processor 350*p* on board the missile 350 (e.g., the processor of the missile's computer system), is programmed with instructions for determining the optimal, in-flight missile intercept approach direction or bistatic angle 370, using the track state and covariance data received from the command and control system 340 and from the seeker's own track data. In other embodiments, the bistatic angle 370 can be pre-computed by the missile's processor, a processor of a computer system associated with the command and control system 340 or any other suitable computer processor, for purposes of determining optimal launch times and initial "GOTO" (go to) point, and/or launch locations. The processor 350*p* selects a bistatic angle 370 that maximizes the probability of correct remote sensor-to-seeker handover, i.e., the correct target association between the remote sensor 330 and the seeker 360 as a function of the bistatic angle 370. The method performed by the programmed processor 350*p* determines the bistatic angle 370 by effectively scanning over a range of bistatic angles and evaluating the probability of correct handover or target association at each angle. Specifically, the processor 350*p* evaluates the probability that the designated object 320 observed by the remote sensor 330 has a closer MD to the true designated object 320 observed by the seeker 360, than any of the other object 310 observed by the seeker 360. In one embodiment, the probability evaluation process is performed by a Monte Carlo method. The Monte Carlo method is a well known computational algorithm that relies on repeated random sampling to compute its result. In other embodiments, the probability of correct handover may be evaluated analytically.

The processor 350*p*, in the Monte Carlo approach scans over the bistatic angles and selects that angle that maximizes the probability of correct remote sensor-to-seeker handover, this angle being the optimal in-flight missile intercept approach direction 370. The processor 350*p* adjusts a guidance and propulsion system 350*gp* of the missile 350 in accordance with this in-flight missile intercept approach direction 370 to steer the missile 350 toward the designated object 320 for interception therewith.

The method performed by processor 350*p* considers the density of the target environment (i.e., the number of objects per unit volume), the distribution of the objects 310 in the target environment 300, the number of objects 310 in common that are observed by both the remote sensor 330 and the seeker 360, respective measurement covariances of the remote sensor 330 and the seeker 360, and relative geometries of the target environment, the remote sensor 330, and the seeker 360.

Figure 4:
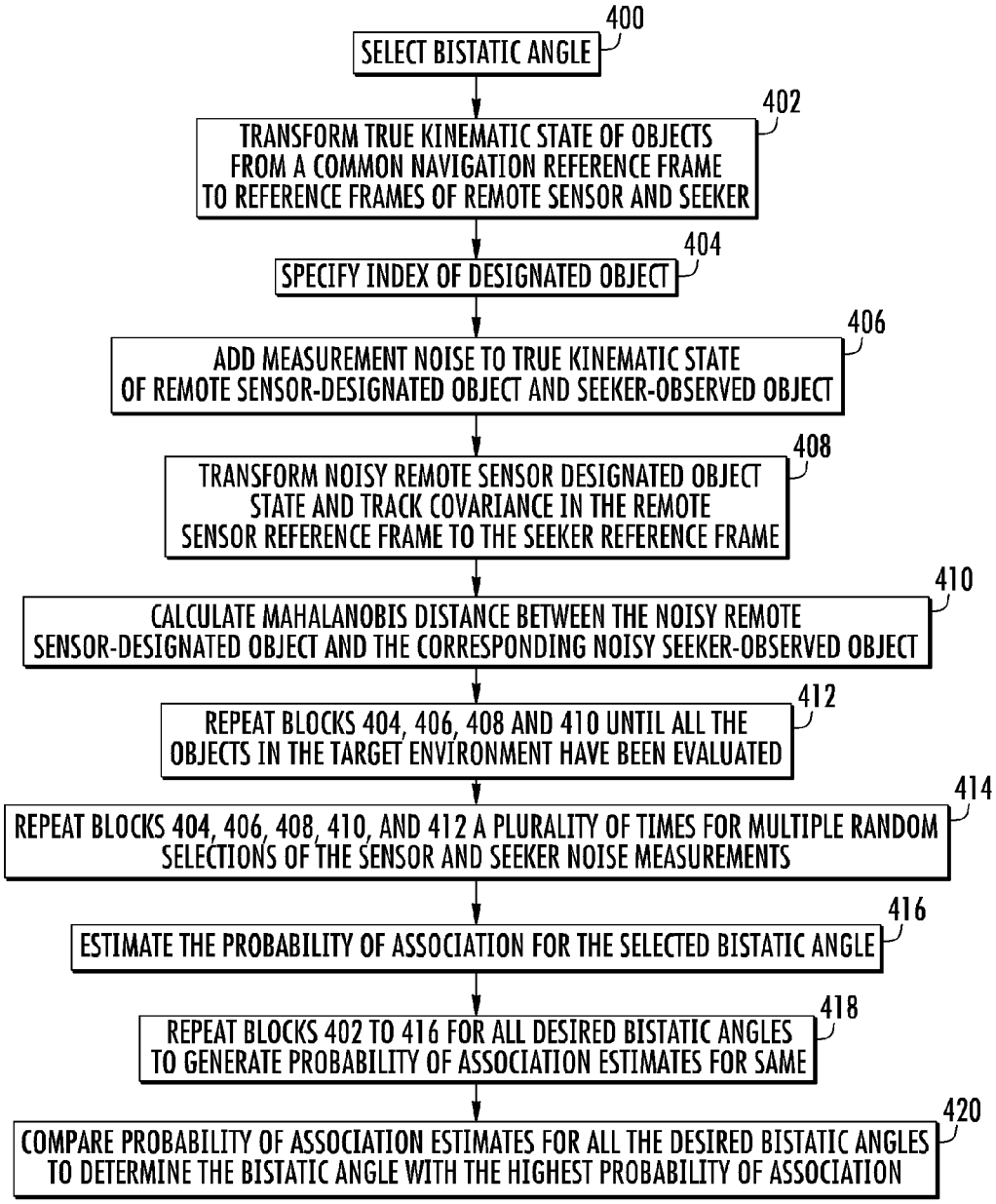
FIG. 4 is a flow chart of the method for determining the optimal, in-flight missile intercept approach direction in a Monte Carlo implementation.

FIG. 4 is a flow chart of the method for determining the optimal, in-flight missile intercept approach direction using the Monte Carlo process. In block 400, a bistatic angle is selected from a range of bistatic angles. In block 402, the true kinematic state (true position) of each object in the target environment is transformed from a common navigation reference frame (i.e. earth centered-earth fixed or earth centered inertial) to the reference frame of the remote sensor and the reference frame of the seeker. In block 404, one of the objects in the target environment is designated for evaluation. In block 406, measurement noise is randomly selected from a zero mean Gaussian distribution consistent with the covariance of the remote sensor, and added to the true position of the designated object (which was transformed earlier in block 404 to the remote sensor reference frame) to produce a noisy remote sensor-designated object state and track covariance in the remote sensor reference frame. Measurement noise is also randomly selected from a zero mean Gaussian distribution consistent with the covariance of the seeker, and added to the true position of the corresponding seeker-observed object (which was transformed earlier in block 404 to the seeker reference frame) to produce a noisy corresponding seeker-observed object state and track covariance in the seeker reference frame. This process can be expressed with the following equations based on a singular value decomposition of 'P':

1) $P=A*S*A^T$, where:

P is the track covariance;

A is a unitary transformation;

S is a singular value representing a diagonal covariance matrix; and $A^T$ is the transpose of A, 2) $v=A*S^{1/2}*u$, where:

v is the noise stream to be added to tracks; and u is the white Gaussian noise with unit variance, 3) u~N (0 mean, covariance given by identity matrix I), where:

N is a normal distribution; and

I is an identity matrix,

4) $\hat{x}=x+v$ $\hat{x}$ is the estimate of true object track state;

x is the true object track state; and v is the random error in the estimate of the true object track state.

In block 408, the noisy remote sensor-designated object state and track covariance in the remote sensor reference frame is transformed to the seeker reference frame. In block 410, the MD is calculated between the noisy remote sensor-designated object state and track covariance in the seeker reference frame (the noisy remote sensor-designated object) and the corresponding noisy seeker-observed object state and track covariance in the seeker reference frame (the corresponding noisy seeker-observed object). In block 412, the processes of blocks 404, 406, 408 and 410 are repeated until all the objects in the target environment have been evaluated. If the MD (handoff or association) between the noisy remote sensor-designated object and the corresponding noisy seeker-observed object is smaller than the MD between the noisy remote sensor-designated object and any other noisy seeker-observed object, the association is considered a success.

In block 414, the process of blocks 404, 406, 408, 410, and 412 are repeated a plurality of times (Monte Carloed) so that data can be generated for multiple random selections of the sensor and seeker noise measurements of block 406. In block 416, the probability of association for the selected bistatic angle is estimated by counting the successful handoffs or associations and calculating the percentage of successes over all the Monte Carlo runs for the selected bistatic angle. In block 418, the method returns to block 400 where another bistatic angle is selected and blocks 402 to 416 are repeated for all the desired bistatic angles, thereby generating probability of association estimates for all the desired bistatic angles. In block 420, the probability of association estimates for all the desired bistatic angles are compared to one another and the bistatic angle with the highest probability of association (highest percentage of successful handovers or associations) is declared the optimal in-flight missile intercept approach direction. The optimal in-flight missile intercept approach direction can then be used to steer the missile toward the designated object for interception therewith.

Figure 5A:
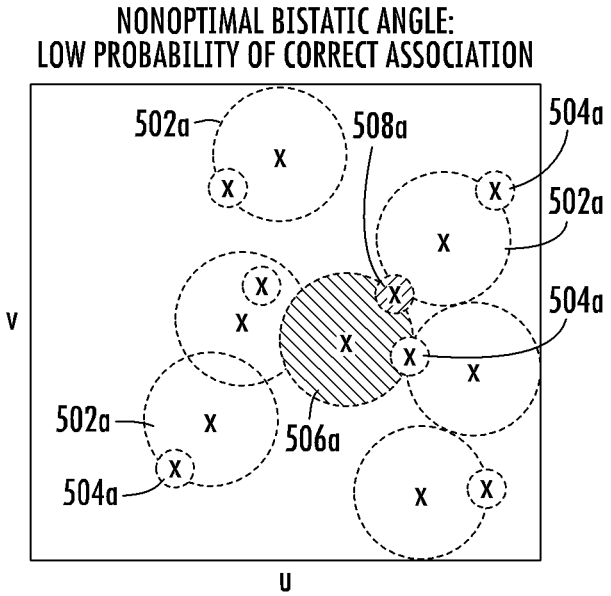
FIG. 5A illustrates a non-optimal bistatic angle with a low probability of correct association.
Figure 5B:
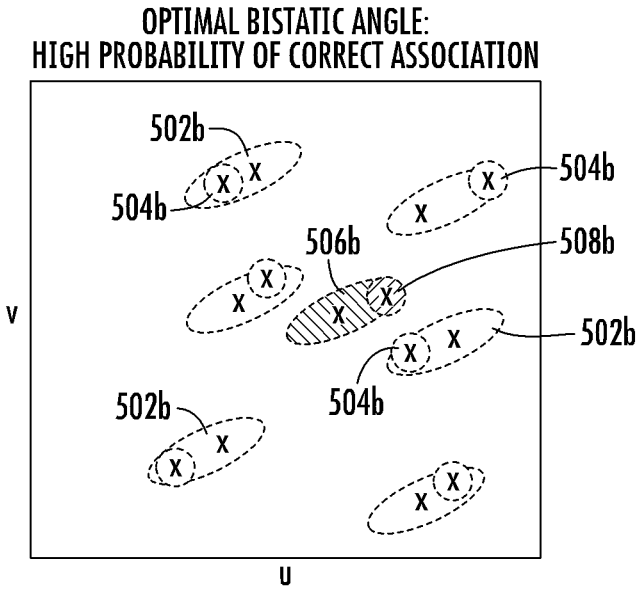
FIG. 5B illustrates an optimal bistatic angle with a high probability of correct association.

The examples given by FIGS. 5A and 5B, illustrate how the rotation of the covariance (error) ellipsoids from the remote sensor, projected onto the seeker FOV, can significantly increase the probability of correct association, where the rotation is determined by selecting the intercept approach direction corresponding to the optimal bistatic angle between the seeker and remote sensor. FIG. 5A illustrates a non-optimal bistatic angle with a low probability of correct association where the elements identified by reference numeral 502*a* represent the track estimates and the error ellipses of the remote sensor-observed objects, the elements identified by reference numeral 504*a* represent the track estimates and the error ellipses of the seeker-observed objects, the element identified by reference numeral 506*a* represents the track estimate and the error ellipse of the remote sensor-observed designated object, projected onto the seeker FOV, and the element identified by reference numeral 508*a* represents the track estimate and the error ellipse of the corresponding seeker-observed designated object.

On the other hand, FIG. 5B illustrates an optimal bistatic angle with a high probability of correct association where the elements identified by reference numeral 502*b* represent the track estimates and the error ellipses of the remote sensor-observed objects, the elements identified by reference numeral 504*b* represent the track estimates and the error ellipses of the seeker-observed objects, the element identified by reference numeral 506*b* represents the track estimate and the error ellipse of the remote sensor-observed designated object, projected onto the seeker FOV, and the element identified by reference numeral 508*b* represents the track estimate and the error ellipse of the corresponding seeker-observed designated object.

Figure 6:
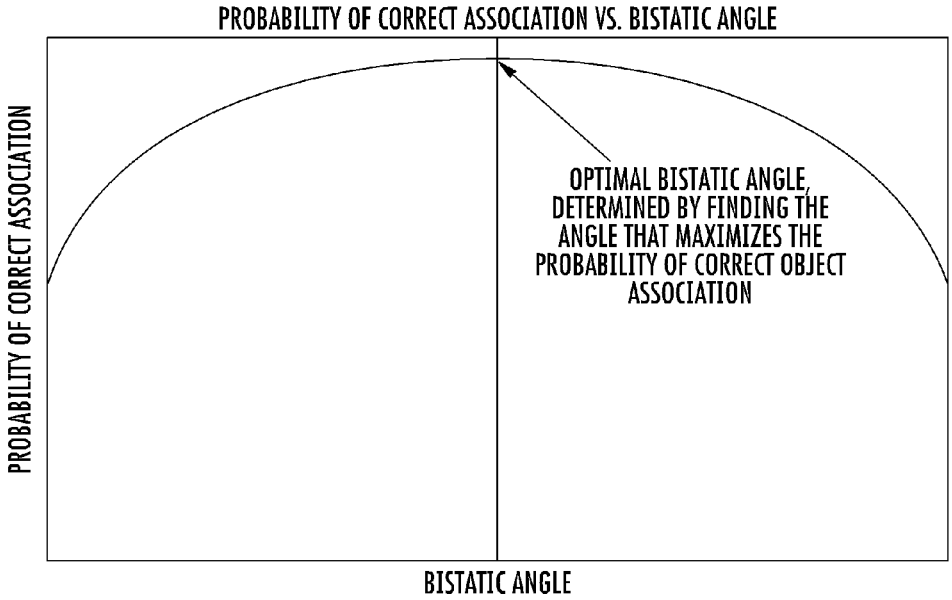
FIG. 6 is a plot of the probability of correct association versus bistatic angle.

FIG. 6 is a plot of the probability of correct association versus bistatic angle. This plot provides an illustrative example of how the probability of correct object association might vary as a function of the bistatic angle. The optimal bistatic angle is determined as the angle that yields the highest probability of correct object association, which in turn yields the optimal intercept approach direction for probability of correct object association.

While exemplary drawings and specific embodiments have been described and illustrated herein, it is to be understood that that the scope of the present disclosure is not to be limited to the particular embodiments discussed. Thus, the embodiments shall be regarded as illustrative rather than restrictive, and it should be understood that variations may be made in those embodiments by persons skilled in the art without departing from the scope of the present invention as set forth in the claims that follow and their structural and functional equivalents.

What is claimed is:

1. A computer implemented method for determining an optimal missile intercept approach direction to maximize the probability of association between a remote sensor designated object and a corresponding missile seeker-observed object, the method comprising:

calculating in a computer processor, a distance metric between the remote sensor designated object and the corresponding missile seeker-observed object; and calculating in the computer processor, the probability that the remote sensor designated object and the corresponding missile seeker-observed object have a smaller distance metric between them than between the remote sensor designated object and any other seeker-observed object; and determining a missile intercept approach direction based on said distance metric and probability calculations from said computer processor.

2. The method of claim 1, wherein the distance metric comprises a Mahalanobis distance metric.

3. The method of claim 1, wherein the calculations are performed analytically, numerically, by Monte Carlo trials and any combination thereof.

4. The method of claim 1, wherein the determining step further comprises:

determining an optimal in-flight approach direction having a highest probability of having a smaller distance metric between the remote sensor designated object and the corresponding missile seeker observed object than between the remote sensor designated object and any other missile seeker observed object.

5. A method for determining an optimal missile intercept approach direction to maximize the probability of correct association between a remote sensor designated object and a corresponding missile seeker-observed object, the method comprising:

scanning over a plurality of bistatic angles between the remote sensor, the designated object, and the missile seeker, in a computer process;

for each bistatic angle:

transforming in a computer process, true kinematic states of the objects to a seeker reference frame;

iteratively adding in a computer process, randomly selected remote sensor and seeker measurement noise to the true kinematic states of the remote sensor designated object and the corresponding missile seeker-observed object;

for each iteration of adding randomly selected measurement noise, calculating in a computer process, a distance metric between the remote sensor designated object and the corresponding missile seeker-observed object; and for all the iterations of adding selected measurement noise, calculating in a computer process, the probability that the remote sensor designated object and the corresponding missile seeker-observed object have a smaller distance metric between them than between the remote sensor designated object any other missile seeker-observed object;

selecting in a computer process as the optimal missile intercept approach direction, the bistatic angle with the highest probability that the remote sensor designated object and the corresponding missile seeker-observed object have a smaller distance metric between them than between the remote sensor designated object and any other missile seeker-observed object.

6. The method of claim 5, wherein the distance metric comprises a Mahalanobis distance metric.

7. The method of claim 5, wherein the transforming of true kinematic states of the objects to a seeker reference frame includes:

transforming the true kinematic states of the remote sensor designated object from a navigation reference frame to a remote sensor reference frame prior to or after iteratively adding the randomly selected remote sensor measurement noise to the true kinematic states of the remote sensor designated object; and transforming the true kinematic states of the remote sensor designated object with the randomly selected remote sensor measurement noise from the remote sensor reference frame to the seeker reference frame prior to calculating the distance metrics between the remote sensor designated object and the corresponding missile seeker-observed object.

8. The method of claim 7, wherein the transforming of true kinematic states of the objects to a seeker reference frame further includes transforming the true kinematic states of the seeker-observed objects from a navigation reference frame to a seeker reference frame prior to or after iteratively adding the randomly selected seeker measurement noise to the true kinematic states of the seeker-observed objects.

9. The method of claim 5, wherein the transforming of true kinematic states of the objects to a seeker reference frame includes transforming the true kinematic states of the seeker-observed objects from a navigation reference frame to a seeker reference frame prior to or after iteratively adding the randomly selected seeker measurement noise to the true kinematic states of the seeker-observed objects.

10. A system for determining an optimal missile intercept approach direction to maximize the probability of association between a remote sensor designated object and a corresponding missile seeker-observed object, the system comprising:

a processor executing instructions for:

calculating a distance metric between the remote sensor designated object and the corresponding missile seeker-observed object; and calculating the probability that the remote sensor designated object and the corresponding missile seeker-observed object have a smaller distance metric between them than between the remote sensor designated object and any other missile seeker-observed object.

11. The system of claim 10, wherein the distance metric comprises a Mahalanobis distance metric.

12. The system of claim 10, wherein the calculations are performed analytically, numerically, by Monte Carlo trials and any combination thereof.

13. A system for determining an optimal missile intercept approach direction to maximize the probability of association between a remote sensor designated object and a corresponding missile seeker-observed object, the method comprising:

a processor executing instructions for:

scanning over a plurality of bistatic angles between the remote sensor, the designated object, and the missile seeker;

for each bistatic angle:

transforming true kinematic states of the objects to a seeker reference frame;

iteratively adding randomly selected remote sensor and seeker measurement noise to the true kinematic states of the remote sensor designated object and the corresponding missile seeker-observed object;

for each iteration of adding randomly selected measurement noise, calculating a distance metric between the remote sensor designated object and the corresponding missile seeker-observed object; and for all the iterations of adding selected measurement noise, calculating the probability that the remote sensor designated object and the corresponding missile seeker-observed object have a smaller distance metric between them than between the remote sensor designated object and any other missile seeker-observed object; and selecting as the optimal missile intercept approach direction, the bistatic angle with the highest probability that the remote sensor designated object and the corresponding missile seeker-observed object have a smaller distance metric between them than between the remote sensor designated object and any other missile seeker-observed object.

14. The system of claim 13, wherein the distance metric comprises a Mahalanobis distance metric.

15. The system of claim 13, wherein the transforming of true kinematic states of the objects to a seeker reference frame includes:

transforming the true kinematic states of the remote sensor designated object from a navigation reference frame to a remote sensor reference frame prior to or after iteratively adding the randomly selected remote sensor measurement noise to the true kinematic states of the remote sensor designated object; and transforming the true kinematic states of the remote sensor designated object with the randomly selected remote sensor measurement noise from the remote sensor reference frame to the seeker reference frame prior to calculating the distance metrics between the remote sensor designated object and the corresponding missile seeker-observed object.

16. The system of claim 15, wherein the transforming of true kinematic states of the objects to a seeker reference frame further includes transforming the true kinematic states of the seeker-observed objects from a navigation reference frame to a seeker reference frame prior to or after iteratively adding the randomly selected seeker measurement noise to the true kinematic states of the seeker-observed objects.

17. The system of claim 13, wherein the transforming of true kinematic states of the objects to a seeker reference frame includes transforming the true kinematic states of the seeker-observed objects from a navigation reference frame to a seeker reference frame prior to or after iteratively adding the randomly selected seeker measurement noise to the true kinematic states of the seeker-observed objects.

* * * * *